United States Patent [19]

Sawayama

[11] Patent Number: 4,897,693

[45] Date of Patent: Jan. 30, 1990

[54] MAGNETIC PARTICLE CARRYING APPARATUS

[75] Inventor: Noboru Sawayama, Tokyo, Japan

[73] Assignee: Ricoh Company, Ltd., Tokyo, Japan

[21] Appl. No.: 139,317

[22] Filed: Dec. 29, 1987

[30] Foreign Application Priority Data

Dec. 29, 1986 [JP] Japan ..... 61-200966[U]

[51] Int. Cl.[4] ..... G03G 15/09; G03G 21/00

[52] U.S. Cl. ..... 355/215; 355/245; 355/251

[58] Field of Search ..... 355/3 R, 3 DD, 215, 355/245, 251, 253, 269, 305; 118/653, 656, 657, 658, 661

[56] References Cited

U.S. PATENT DOCUMENTS

| | | | |
|---|---|---|---|
| 3,809,012 | 5/1974 | Delvecchio | 118/644 |
| 3,900,002 | 8/1975 | Stange | 355/3 DD X |
| 4,142,165 | 2/1979 | Miyakawa et al. | 355/3 DD X |
| 4,285,297 | 8/1981 | Suzuki | 118/657 |
| 4,528,936 | 7/1985 | Shimazaki et al. | 118/653 |
| 4,575,220 | 3/1986 | Sakamoto et al. | 355/3 DD |

OTHER PUBLICATIONS

Caudill, A. H., "Developer Anti-Dusting Curtain", IBM Technical Disclosure Bulletin, vol. 20, No. 1, pp. 27 and 28, Jun. 1977.

*Primary Examiner*—Fred L. Braun

*Attorney, Agent, or Firm*—Oblon, Spivak, McClelland, Maier & Neustadt

[57] ABSTRACT

A magnetic particle carrying apparatus including a housing having an opening and a magnetic particle carrying member installed in the housing for carrying magnetic particles. The carrying member faces through the opening a latent image carrier for carrying an electrostatic latent image. In addition, the apparatus includes a seal member which is secured to a part of the housing opposite to a region on a periphery of the latent image carrier just before the opening and which extends to a vicinity of an area in which the periphery of the latent image carrier and a periphery of the magnetic particle carrying member are close to each other. The seal member has two extensions which cover areas near the ends of the magnetic particle carrying member.

10 Claims, 3 Drawing Sheets

MAGNETIC PARTICLE CARRYING APPARATUS

FIELD OF THE INVENTION

The present invention generally relates to a magnetic particle carrying apparatus, and in particular to a magnetic particle carrying apparatus installed in an image forming apparatus such as a copying machine.

BACKGROUND OF THE INVENTION

A copying machine which is one of image forming apparatuses is widely used. As is well known, there are various types of copying machines. An electrostatic type copying machine employing a dry process developing method is one of the most popular machines. In the copying machine of this type, an electrostatic latent image is formed on a photoconductive drum, and the electrostatic image is then developed by use of a developing material which is formed as a magnetic brush. The development of the latent image is generally carried out by a dry process developing apparatus which includes a cylindrical developing sleeve facing the photoconductive drum.

A plurality of stationary permanent magnets, which are installed inside the developing sleeve, hold the magnetic particles on a periphery of the sleeve by magnetic attraction. The magnetic particles held on the periphery of the developing sleeve are called the magnetic brush for the development of the latent image. The developing sleeve is rotationally driven with respect to the magnets. The magnetic particles attracted onto the periphery of the sleeve are conveyed through the rotation of the sleeve and brought in contact with the photoconductive drum through an opening of a housing which accommodates the developing sleeve and an apparatus for supplying the magnetic particles to the developing sleeve. Thereby, the latent image on the photoconductive drum is developed to be processed into an image of the magnetic particles. This image is frequently called a toner image. The toner image is transferred to a sheet of paper, which is then subjected to a fixing process.

On the other hand, the cleaning of the photoconductive drum is made by use of, for example, a cleaning apparatus in which a magnetic brush of the magnetic particles is formed on a cleaning sleeve, which is almost the same as the sleeve of the developing apparatus. That is, the magnetic brush formed on the sleeve of the cleaning apparatus is brought into contact with the periphery of the photoconductive drum through an opening of a housing which accommodates the cleaning sleeve and other elements.

The developing apparatus and the cleaning apparatus of the above type have a problem described below. The magnetic particles carried on the periphery of the developing sleeve which is in the rotational state are affected by various forces due to mucosity of air, centrifugal force and the like. Thereby, some magnetic particles attracted on the periphery of the sleeve are liable to be removed and scattered into the air. The scattered magnetic particles smear the developed image formed on the photoconductive drum and other peripheral elements. As a result, the quality of the image transferred onto the paper is degraded.

For this reason, various means for preventing the scattering of the magnetic particles are provided for the conventional dry process developing apparatus. For example, the Japanese Laid-Open Utility Model Application No. 95360/1984, or the U.S. Pat. No. 4,592,653 (the assignee of which is the same as the assignee of the present application) discloses a seal member of a fur brush type, which is located over the developing sleeve. The front ends of the fur brush are kept in contact with the periphery of the photoconductive drum in its axial direction. This fur brush is effective in preventing the scattering of the magnetic particles which leak from the intermediate portion of the developing sleeve. However, the fur brush cannot totally seal the scattering resulting from both sides of the developing sleeve in its axial direction.

To cope with this scattering, it is necessary to seal a gap between the ends of the developing sleeve and an inner wall of the housing as well as a gap between the ends of the photoconductive drum and the ends of the developing apparatus. As anticipated from the above description, to effectively prevent the scattering with respect to the photoconductive drum, a number of independent seal members must be provided. For this reason, the conventional scheme for preventing the scattering is expensive, and the operation of attaching the seals is complex and cumbersome.

The situation described above is the same as for the magnetic brush cleaning apparatus. The magnetic particles which fly from the magnetic brush formed on the cleaning sleeve are deposited on and smear the periphery of the photoconductive drum.

As is well known, the magnetic particles are mainly classified into a one-component magnetic toner and a two-component magnetic toner. The one-component magnetic toner has the property of magnetic material. On the other hand, the two-component toner is made up of toner particles and iron particles. The above problems are particularly prominent for the two-component magnetic toner.

OBJECTS OF THE INVENTION

Accordingly, a general object of the present invention is to provide a novel and useful magnetic particle carrying apparatus in which the disadvantages of the conventional art have been eliminated.

A more specific object of the present invention is to provide a magnetic particle carrying apparatus which can prevent the scattering of the magnetic particles effectively and economically.

Another object of the present invention is to provide a magnetic particle carrying apparatus in which the assembling operation is easy.

SUMMARY OF THE INVENTION

The above objects of the present invention can be attained by a magnetic particle carrying apparatus including a housing having an opening and a magnetic particle carrying member installed in the housing for carrying magnetic particles. The carrying member faces through the opening a latent image carrier for carrying an electrostatic latent image. The apparatus further comprises a sheet member which is secured to a part of the housing opposite to a region on a periphery of the latent image carrier located just before the opening. The sheet member extends to a vicinity of an area in which the periphery of the latent image carrier and a periphery of the magnetic particle carrying member are close to each other. The sheet member has two extensions which cover areas near the ends of the magnetic particle carrying member.

Preferably, each of the extensions of the sheet member covers the above area, which is located between an end of the opening of the housing near the end of the magnetic particle carrying member and a position which is located inside an end of a toner carrying region on the periphery of the magnetic particle carrying member and which is in the vicinity of the above end.

Other objects, features and advantages of the present invention will become apparent from the following detailed description when read in conjunction with the accompanying drawings.

BRIEF DESCRIPTION OF THE DRAWINGS

FIG. 3 is a disassembled view for showing a relationship between a housing, an upper cover, a seal member and so on;

DETAILED DESCRIPTION

Firstly, a description will be given of a conventional magnetic particle carrying apparatus with reference to FIG. 1, to facilitate the better understanding of the present invention described in detail later.

Figure 1:
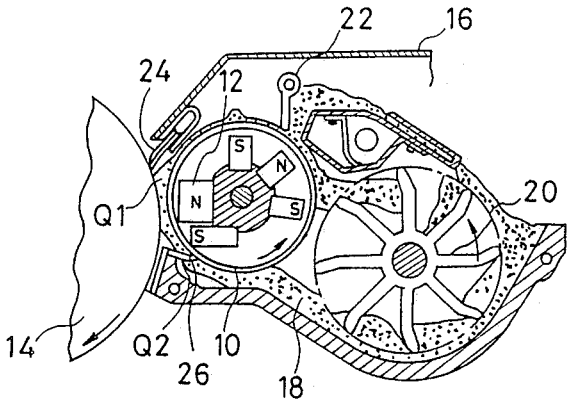
FIG.1 PRIOR ART
FIG. 1 is a sectional view of a conventional magnetic particle carrying apparatus.

FIG. 1 shows a sectional view of a prior apparatus as disclosed in the above-indicated publications. A dry process developing apparatus illustrated comprises a cylindrical developing sleeve 10 which is installed in a housing 16. The developing sleeve 10 faces a photoconductive drum 14 through an opening of the housing 16, which defines a developing region. The photoconductive drum 14, which is rotatable as indicated by an arrow, carries an electrostatic latent image. In the developing sleeve 10, there are fixed a plurality of stationary permanent magnets. The developing sleeve 10 may be driven to rotate as indicated by the arrow with respect to the stationary permanent magnets.

The magnets function to attract the magnetic particles or toner particles 18 onto the periphery of the developing sleeve 10. Out of the magnets, a main pole 12 is used to raise a nap of the toner in the developing region in which the periphery of the developing sleeve 10 is positioned very close to the periphery of the photoconductive drum 14. The other magnets contribute to convey the toner particles 18 on the developing sleeve 10.

A doctor blade 22 positioned at an upper part of the housing 16 is used to keep the toner particles 18 on the developing sleeve 10 at a constant thickness to form a magnetic brush. The toner particles 18 are accommodated in a bottom part of the housing 16 and supplied to the developing sleeve 10 by a toner supply roller 20 which is rotatable as indicated by an arrow.

A seal member 24 constituted by a fur brush is fixed to the upper part of the opening of the housing 16. The opening forms the developing region described above. The end of the fur brush of the seal member 24 is kept in light contact with the periphery of the photoconductive drum 14. The seal member 24 is provided to seal the developing sleeve 10 with respect to the photoconductive drum 14 to prevent the scattering of the toner particles 18.

The raised nap of the toner indicated by a symbol Q1 is liable to be removed and scatter because of the various forces mentioned before. The scattered toner forms a toner cloud. Therefore, the seal member 24 is useful to prevent the toner particles 18 from flying from the developing sleeve 10 through a gap between the periphery of the photoconductive drum 14 and the upper edge of the opening of the housing 16.

A raised nap part Q2 of the toner is also liable to leak from the developing sleeve 10 to make a toner cloud around its vicinity. The scattered toner particles 18 in this vicinity is captured by another seal member 26 constituted by a fur brush which is secured to a lower part of the opening of the housing 16 in such a way that the end of the fur brush is kept in light contact with the periphery of the developing sleeve 10. Thereby, the scattering of the toner particles 18 through a gap between the lower end of the opening and the periphery of the photoconductive drum 14 is effectively prevented.

However, the conventional apparatus as described above has the disadvantages indicated before. The seal members 24 and 26 are not effective to prevent the scattering of the toner at both ends of the developing sleeve 10. To prevent this, various additional seals must be provided. For example, the gap between the ends of the developing sleeve 10 and the inner walls of the housing 16 must be sealed. Further, the gap between the ends of the photoconductive drum 14 and the ends of the developing sleeve 10 must be sealed. Furthermore, in a certain case, it would be necessary to provide seal members in a gap between the end part of the doctor blade 22 and the ends of the developing sleeve 10 and an area behind the developing sleeve 10. That is, various seal members are necessary to totally prevent the scattering of the toner particles 18. Additionally, it should be noted that manufacturing of the fur brushes is very complicated and cumbersome. Consequently, the apparatus becomes very expensive and unreliable.

The situation is the same as that for the magnetic brush cleaning apparatus for cleaning the periphery of the photoconductive drum by means of the magnetic brush formed on the cleaning sleeve.

Accordingly, the present invention intends to eliminate the disadvantages of the conventional apparatus.

A description will be given of an embodiment of the present invention with reference to FIGS. 2 through 6.

The present invention can be applied to the dry process developing apparatus and the magnetic brush cleaning apparatus. In the following description, a dry process developing apparatus constituted according to the present invention is explained as an example.

Figure 2:
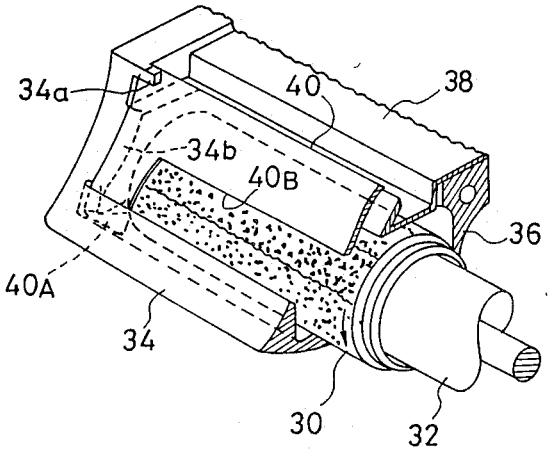
FIG. 2 is a perspective view of essential parts of an embodiment of the present invention.
Figure 3:
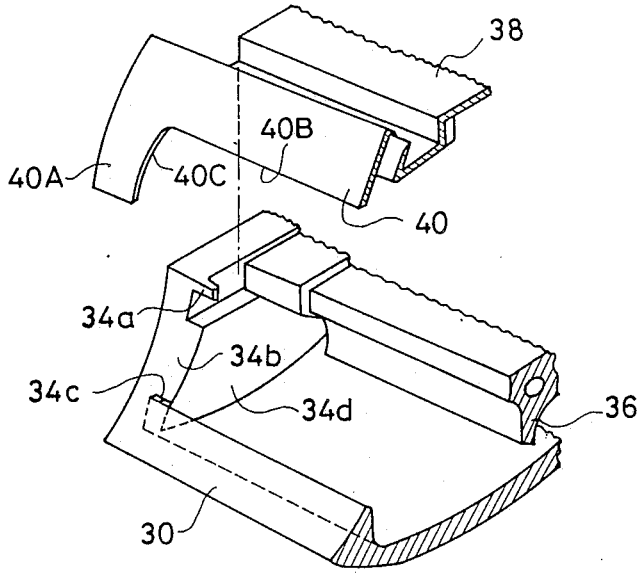

FIG. 2 is a perspective view of essential parts of the embodiment of the present invention. A developing sleeve 30 forms magnetic particles (i.e., toner) onto its periphery. The developing sleeve 30 is one example of a magnetic particle carrying member. A stationary magnet roll 32 is installed in an inner part of the developing sleeve 30. The stationary magnet roll 32 corresponds to the plurality of permanent magnets as illustrated in FIG. 1. The developing sleeve 30 is rotationally driven as indicated by an arrow with respect to the stationary magnet roll 32.

Figure 4:
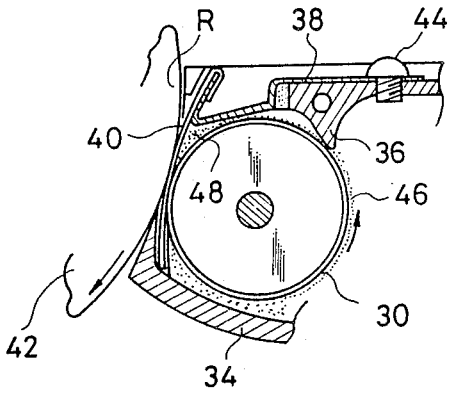
FIG. 4 is a sectional view of essential parts of the embodiment of the present invention.

The developing sleeve 30 is accommodated into a housing 34 of the dry process developing apparatus in a state where the developing sleeve 30 is rotatable. That is, a shaft coupled with the developing sleeve 30 is rotatably supported on both side walls of the housing 34. The housing 34 accommodates the toner in its bottom part. The developing sleeve 30 is located very close to a photoconductive drum 42 in a state where the periphery of the developing sleeve 30 is opposite to that of the photoconductive drum 42 through an opening of the housing 34, as shown in FIG. 4. The photoconductive drum 42 carries an electrostatic latent image which is formed by light reflected from a document scanned by an optical system.

A doctor blade 36 extending downwards is integrally formed at an upper part of the housing 34. The doctor blade 36 has a function of removing the unnecessary part of the toner to form toner of a constant thickness. The toner thus formed is brought in contact with the periphery of the photoconductive drum 42 and provided for the development of the electrostatic latent image formed thereon.

As is clearly shown in FIG. 4, an upper cover 38 is secured to the upper part of the housing 34 by screws 44 (only one of which is shown). As is also clearly shown in FIG. 4, the upper cover 38 has a part which extends upwards in the right-hand side direction. A sheet member 40 is secured to this extending part of the upper cover 38 by use of adhesive such as adhesive double coated tape in a state where a part of the sheet member 40 is turned down. In other words, the sheet member 40 is secured to the part of the housing 34 which is opposite to a region R (FIG. 4) on the periphery of the photoconductive drum 42 just before the opening of the housing 34. The sheet member 40 extends down to the vicinity of an area in which the periphery of the developing sleeve 30 is close to the periphery of the photoconductive drum 42. The sheet member 40 will be described in more detail later.

Figure 5:
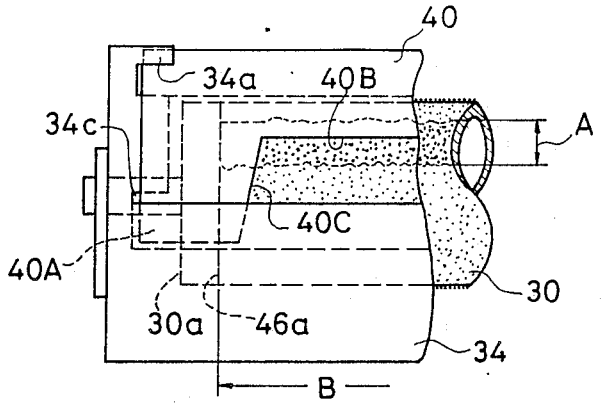
FIG. 5 is a view for explaining an extension of the seal member of the embodiment.

In FIG. 5, a reference 30*a* denotes an end part of the developing sleeve 30 in its axial direction. A reference 'A' denotes a nap of toner raised due to the magnetic force of the stationary magnet roll 32, and the reference 'B' denotes a region within which the toner is carried on the periphery of the developing sleeve 30 to form the magnetic brush.

The sheet member 40 has two extensions which extend downwards from parts of the sheet member 40 corresponding to both the ends of the developing sleeve 30 in its axial direction. In FIGS. 2 through 6, one extension 40A of the two extensions positioned on the left-hand side is illustrated and the other is not shown. The extension 40A covers an area between a front end 34*b* of the housing 34 near the end of the developing sleeve 30 and a position which is located inside an end 46*a* of the toner carrying region B on the sleeve periphery and which is in the vicinity of the end 46*a*. The other extension of the sheet member 40 is similarly formed.

The sheet member 40 is attached in such a way that its side end is located inside a projection 34*a* and is in contact with the front end 34*b* of the housing 34, and a lowermost end of the extension 40A is fitted into a groove 34*c* formed at the lower end of the housing 34. The attachment of the sheet member 40 to the front end 34*b* of the housing 34 may be made by use of adhesive such as an adhesive double coated tape. An end 40B of the sheet member 40 in the axial direction of the developing sleeve 30 is in light contact with the magnetic brush formed on the periphery of the photoconductive drum 42. Also, an inner side end 40C of the extension 40A of the sheet member 40 extending downwards is kept very close to or in light contact with the periphery of the photoconductive drum 42. This will be described in more detail later. Of course, the other extension of the sheet member 40 is formed and attached as in the case of the extension 40A.

The sheet member 40 must have properties of flexibility, thin film and a high resistance. Preferably, the thickness of the sheet member 40 is equal to or less than 0.5 mm, and particularly 0.2 mm or less is optimum. The resistance of $10^8\Omega$/cm or more, particularly $10^9\Omega$/cm or more is preferable, which is measured between the lowermost end and its opposite end of the sheet member 40 which engages with the projection 34*a*. For example, polyurethane resin is used for the material of the sheet member 40.

The sheet member 40 thus formed makes it possible to effectively prevent the toner from scattering through the gap between the ends of the developing sleeve 30 and the inner walls 34*d* of the housing 34. Additionally, the scattering of the toner through a gap 48 (FIG. 4) between the upper cover 38 and the photoconductive drum 42 can be effectively prevented.

An explanation of the effects of the extensions 40A will be described below with reference to FIGS. 6 and 7.

Figure 6:
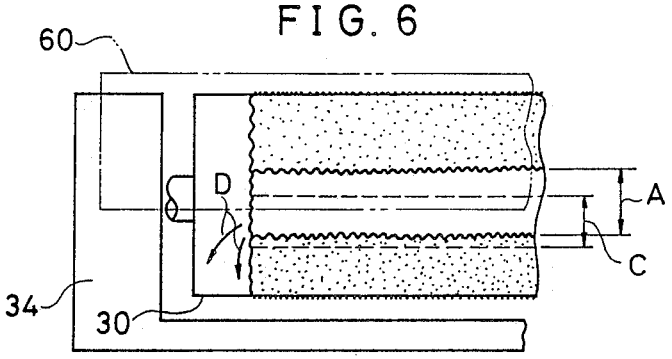
FIG. 6 is a view for explaining a problem in a case where a rectangular sheet member is used.

Referring to FIG. 6, a case is assumed that a rectangular sheet member 60 illustrated by two-dotted chain line is used in place of the sheet member 40. A reference 'C' denotes a contact part between the toner carried on the developing sleeve 30 and the photoconductive drum 42. The toner density of the toner cloud around an area in the vicinity of the contact part C and the raised nap part A is high. In addition, the above area is exposed through the opening of the housing 34. For these reasons, the toner is liable to scatter in a direction indicated by an arrow D, and be carried with a flow of air caused by the rotation of the photoconductive drum 42.

Figure 7:
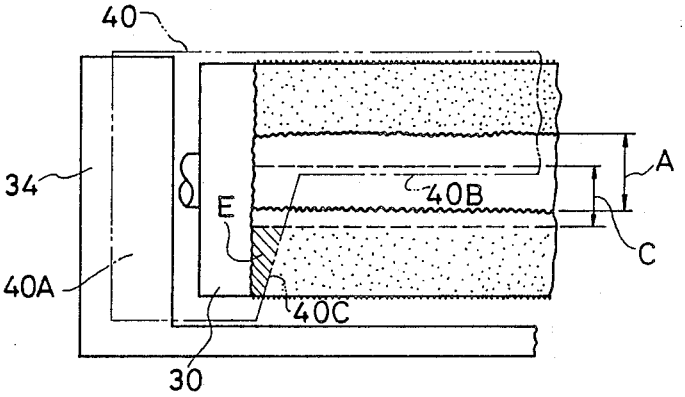
FIG. 7 is a view for explaining advantages provided by the present invention.

On the other hand, as shown in FIG. 7, the sheet member 40 having the peculiar shape of the extensions 40A on both the sides thereof can reduce the toner density of the toner cloud around the area in the vicinity of the contact part C and the raised nap part A, and it can totally prevent the above area from being exposed. To ensure the better sealing function described above, it is necessary to make a part E of the extension 40A closer to the toner on the developing sleeve 30 or bring the part E in light contact with the toner. For this purpose, the groove 34*c* is formed at the lower part of the housing 34, and the lowermost part of the extension 40A is fitted therein. As a result, the extension 40A, particularly the part E, may behave like a streamer and is attached in a direction such that it is made closer to or brought in light contact with the toner carried on the developing sleeve 30.

The sheet member provided by the present invention is suitable for the one-component magnetic toner, and particularly the two-component magnetic toner. In the case of the two-component magnetic tone, the leakage and scattering of the toner from the developing sleeve 30 occurs only when the raised nap of the toner or the magnetic brush is formed at the positions at which the magnetic poles are located. In other words, the leakage and scattering do not occur at positions other than positions where the raised nap of the toner occurs. The end 40B and the extensions 40A of the sheet member 40 can cope with the scattering of the toner which flies from the raised nap of the toner, as described before.

The present invention is not limited to the embodiment described above, but various variations and modifications may be made without departing from the scope of the present invention. For example, the present invention may be applied to an apparatus in which the developing sleeve 30 and the photoconductive drum 42 are driven in rotational directions reverse to those in the embodiment described above. In this case, the sheet member is secured to the lower part of the housing and extends to the vicinity of the area in which the periphery of the photoconductive drum and the periphery of the developing sleeve are close each other. The two extensions extend upwards and the ends thereof are fitted into the grooves formed at the upper part of the housing. The present invention is also applicable to a belt type photoconductive carrier. Moreover, the present invention may be suitably applied to the magnetic brush cleaning apparatus.

What is claimed is:

1. A magnetic particle carrying apparatus comprising:

(a) a housing having an opening adapted to face a latent image carrier;

(b) a magnetic particle carrying member installed in said housing for carrying magnetic particles, said magnetic particle carrying member being positioned so as to face the latent image carrier through the opening; and (c) a sheet member:

(i) secured to a part of said housing opposite to a region on a periphery of the latent image carrier located just before the opening;

(ii) extending to the vicinity of an area in which the periphery of the latent image carrier and the periphery of said magnetic particle carrying member are close to each other; and (iii) having two extensions covering areas near the ends of said magnetic particle carrying member, wherein:

(d) each of said two extensions of said sheet member covers the area which is located between a front end of said housing near the end of said magnetic particle carrying member and a position which is located inside an end of a magnetic particle carrying region on the periphery of said magnetic particle carrying member and which is in the vicinity of the end of the magnetic particle carrying region;

(e) an end of each of said two extensions of said sheet member is fitted into a corresponding groove formed at a part of said housing opposite to the part thereof at which said sheet member is secured; and (f) said two extensions of said sheet member engage with corresponding projections located at the part of said housing opposite to the region on the periphery of the latent image carrier just before the opening.

2. A magnetic particle carrying apparatus as claimed in claim 1, wherein an end in the axial direction between said two extensions of said sheet member is in contact with the magnetic particles carried on the periphery of said magnetic particle carrying member.

3. A magnetic particle carrying apparatus as claimed in claim 1, wherein inner side ends of said two extensions are kept into contact with the magnetic particles carried on the periphery of said magnetic particle carrying member.

4. A magnetic particle carrying apparatus as claimed in claim 1, wherein the thickness of said sheet member is equal to or less than 0.5 mm.

5. A magnetic particle carrying apparatus as claimed in claim 1, wherein the resistance of said sheet member is $10^8$ Ω/cm or more, measured between the lowermost end and the opposite end of said sheet member.

6. A magnetic particle carrying apparatus as claimed in claim 1, wherein said sheet member is made of polyurethane resin.

7. A magnetic particle carrying apparatus as claimed in claim 1, wherein the magnetic particles are made up of a one-component magnetic toner.

8. A magnetic particle carrying apparatus as claimed in claim 1, wherein the magnetic particles are made up of a two-component magnetic toner.

9. A magnetic particle carrying apparatus as claimed in claim 1, wherein said magnetic particle carrying member is a developing sleeve of a dry process developing apparatus.

10. A magnetic particle carrying apparatus as claimed in claim 1, wherein said magnetic particle carrying member is a cleaning sleeve of a magnetic brush cleaning apparatus.

* * * * *